US010019943B2

(12) United States Patent
Wu

(10) Patent No.: US 10,019,943 B2
(45) Date of Patent: Jul. 10, 2018

(54) PIXEL COMPENSATION CIRCUITS, SCANNING DRIVING CIRCUITS AND FLAT DISPLAY DEVICES

(71) Applicant: Shenzhen China Star Optoelectronics Technology Co., Ltd., Shenzhen, Guangdong (CN)

(72) Inventor: Xiaoling Wu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 211 days.

(21) Appl. No.: 15/024,853

(22) PCT Filed: Feb. 25, 2016

(86) PCT No.: PCT/CN2016/074555

§ 371 (c)(1),
(2) Date: Mar. 24, 2016

(87) PCT Pub. No.: WO2017/128468

PCT Pub. Date: Aug. 3, 2017

(65) Prior Publication Data

US 2018/0040275 A1 Feb. 8, 2018

(30) Foreign Application Priority Data

Jan. 29, 2016 (CN) ..... 2016 1 0064270

(51) Int. Cl.
*G09G 3/3233* (2016.01)
*G09G 3/3266* (2016.01)
*G09G 3/36* (2006.01)

(52) U.S. Cl.
CPC ..... *G09G 3/3233* (2013.01); *G09G 3/3266* (2013.01); *G09G 3/3648* (2013.01);
(Continued)

(58) Field of Classification Search
CPC ..... G09G 3/30; G09G 3/32; G09G 3/3208; G09G 3/3225; G09G 3/3233;
(Continued)

(56) References Cited

U.S. PATENT DOCUMENTS 7,038,392 B2 5/2006 Libsch et al.
2003/0052614 A1 3/2003 Howard
(Continued)

FOREIGN PATENT DOCUMENTS

CN 102222468 A 10/2011
CN 104036732 A 9/2014
(Continued)

*Primary Examiner* — Premal R Patel
(74) *Attorney, Agent, or Firm* — Andrew C. Cheng

(57) ABSTRACT

The present disclosure relates to pixel compensation circuit, pixel compensation method and flat display device. Control ends of first to third, fourth, and fifth controllable transistors connect to first to third, third, and fourth scanning lines, first end of first controllable transistor connects to data line, control end of driving transistor connects to second ends of first controllable transistor, and second controllable transistors through storage capacitor, and first end of third controllable transistor; first end of second controllable transistor connects to first voltage end, second end of driving transistor connects to second end of second controllable transistor and anode of OLED; cathode of OLED is grounded; first end of driving transistor connects to second ends of third and fifth controllable transistors and first end of fourth controllable transistor, second end of fourth controllable transistor connects to reference voltage end; first end of fifth controllable transistor connects to second voltage end.

2 Claims, 3 Drawing Sheets

(52) U.S. Cl.
CPC ..... *G09G 2300/0819* (2013.01); *G09G 2320/0233* (2013.01); *G09G 2330/021* (2013.01)

(58) Field of Classification Search
CPC ..... G09G 3/3266; G09G 2320/0233; G09G 2330/021; G09G 2300/0819; G09G 3/3648
See application file for complete search history.

(56) References Cited

U.S. PATENT DOCUMENTS

| | | | | |
|---|---|---|---|---|
| 2007/0115225 | A1 | 5/2007 | Uchino et al. | |
| 2013/0082910 | A1* | 4/2013 | Lee ..... | G09G 3/3208 345/76 |
| 2014/0313232 | A1* | 10/2014 | Han ..... | G09G 3/3696 345/690 |
| 2015/0317931 | A1* | 11/2015 | Tseng ..... | G09G 3/3233 345/78 |
| 2016/0180774 | A1* | 6/2016 | Yang ..... | G09G 3/3233 345/214 |

FOREIGN PATENT DOCUMENTS

| | | | |
|---|---|---|---|
| CN | 104282263 | A | 1/2015 |
| CN | 106128360 | A | 11/2016 |

* cited by examiner

PIXEL COMPENSATION CIRCUITS, SCANNING DRIVING CIRCUITS AND FLAT DISPLAY DEVICES

BACKGROUND OF THE INVENTION

1. Field of the Invention

The present disclosure relates to display technology, and more particularly to a pixel compensation circuit, a scanning driving circuit, and a flat display device.

2. Discussion of the Related Art

Organic light emitting diode (OLED) displays are characterized by attributes such as small dimensional, simple structure, emitting light itself, large viewing angle, and short response time, and thus have drew a great deal attentions.

Conventional OLED display includes one transistor operating as a driving transistor to control the current passing through the OLED, and thus the threshold voltage of the driving transistor is very critical. Different current may pass through the OLED regardless of the positive drift or negative drift of the threshold voltage even when the data signals are the same. Currently, during the operations, the transistor may cause the threshold voltage drift due to the lighting of the oxide semiconductor, source/drain electrode and the voltage stress, and thus the current passing through the OLED may be unstable, which may result in non-uniform brightness of the panel.

SUMMARY

The present disclosure relates to a pixel compensation circuit, a pixel compensation method and the flat display device to avoid unstable current of the OLED caused by threshold voltage drifting so as to enhance the brightness of the panel.

In one aspect, a pixel compensation circuit includes: a first controllable transistor having a control end, a first end, and a second end, the control end of the first controllable transistor connects to a first scanning line, and the first end of the first controllable transistor connects to one data line; a driving transistor having a control end, a first end, and a second end, the control end of the driving transistor connects to the second end of the first controllable transistor; a second controllable transistor having a control end, a first end, and a second end, the control end of the second controllable transistor connects to a second scanning line, and the second end of the second controllable transistor connects to the second end of the driving transistor; an OLED having an anode and a cathode, the anode of the OLED connects to the second end of the driving transistor, and the cathode of the OLED is grounded; a storage capacitor having a first end and a second end, the first end of the storage capacitor connects to the second end of the second controllable transistor, and the second end of the storage capacitor connects to the control end of the driving transistor; a third controllable transistor having a control end, a first end, and a second end, the control end of the third controllable transistor connects to a third scanning line, the first end of the third controllable transistor connects to the control end of the driving transistor and the second end of the storage capacitor, and the second end of the third controllable transistor connects to the first end of the driving transistor; a fourth controllable transistor having a control end, a first end, and a second end, the control end of the fourth transistor connects to the third scanning line, the first end of the fourth transistor connects to the first end of the driving transistor, and the second end of the fourth transistor connects to one reference voltage end; and a fifth controllable transistor having a control end, a first end, and a second end, the control end of the fifth controllable transistor connects to a fourth scanning line, a first end of the fifth controllable transistor connects to a second voltage end, and the second end of the fifth controllable transistor connects to the first end of the driving transistor.

Wherein the driving transistor, the first controllable transistor through the fifth controllable transistor are NMOS TFTs, PMOS TFTs, or a combination of the NMOS TFTs and the PMOS TFTs, the control end, the first end, and the second end of the first controllable transistor through the fifth controllable transistor respectively correspond to a gate, a drain, and a source of the TFT.

In another aspect, a pixel compensation method includes: during a reset phase, the driving transistor, and the second controllable transistor through the fourth controllable transistor are turned on, and the first controllable transistor and the fifth controllable transistor are turned off, a voltage at the control end of the driving transistor equals to a reference voltage outputted by a reference voltage end, and the voltage at the second end of the driving transistor equals to a first voltage outputted by the first voltage end; during a threshold voltage fetching phase, the driving transistor, the third controllable transistor, and the fourth controllable transistor are turned on, and the first controllable transistor, the second controllable transistor, and the fifth controllable transistor are turned off, the voltage at the control end of the driving transistor equals to the reference voltage, and the voltage at the second end of the driving transistor equals to a difference between the reference voltage and a threshold voltage of the driving transistor; during a data writing phase, the driving transistor and the first controllable transistor are turned on, and the second controllable transistor through the fifth controllable transistor are turned off, and the storage capacitor is charged, the voltage at the control end of the driving transistor equals to the data voltage outputted by the data line, and the voltage at the second end of the driving transistor satisfies the equation below:

$$Vs=V\text{ref}-Vth+\Delta V;$$

wherein Vref represents the reference voltage, Vth represents the threshold voltage of the driving transistor, ΔV represents the voltage increments of the second end of the driving transistor; and during a driving light-emitting phase, the driving transistor and the fifth controllable transistor are turned on, the first controllable transistor through the fourth controllable transistor are turned off, and voltage between the control end and the second end of the driving transistor satisfies the equation below:

$$Vgs=V\text{data}-V\text{ref}+Vth-\Delta V;$$

a current passing through the OLED satisfies the equation below:

$$I=K*(Vgs-Vth)^2=K*(V\text{data}-V\text{ref}-\Delta V)^2;$$

wherein Vdata represents the data voltage outputted by the data line, and K is a coefficient.

Wherein the driving transistor, the first controllable transistor through the fifth controllable transistor are NMOS TFTs, PMOS TFTs, or a combination of the NMOS TFTs and the PMOS TFTs, the control end, the first end, and the second end of the first controllable transistor through the fifth controllable transistor respectively correspond to a gate, a drain, and a source of the TFT.

In another aspect, a flat display device includes a scanning driving circuit, the scanning driving circuit includes a pixel compensation circuit, and the pixel compensation circuit includes: a first controllable transistor having a control end, a first end, and a second end, the control end of the first controllable transistor connects to a first scanning line, and the first end of the first controllable transistor connects to one data line; a driving transistor having a control end, a first end, and a second end, the control end of the driving transistor connects to the second end of the first controllable transistor; a second controllable transistor having a control end, a first end, and a second end, the control end of the second controllable transistor connects to a second scanning line, and the second end of the second controllable transistor connects to the second end of the driving transistor; an OLED having an anode and a cathode, the anode of the OLED connects to the second end of the driving transistor, and the cathode of the OLED is grounded; a storage capacitor having a first end and a second end, the first end of the storage capacitor connects to the second end of the second controllable transistor, and the second end of the storage capacitor connects to the control end of the driving transistor; a third controllable transistor having a control end, a first end, and a second end, the control end of the third controllable transistor connects to a third scanning line, the first end of the third controllable transistor connects to the control end of the driving transistor and the second end of the storage capacitor, and the second end of the third controllable transistor connects to the first end of the driving transistor; a fourth controllable transistor having a control end, a first end, and a second end, the control end of the fourth transistor connects to the third scanning line, the first end of the fourth transistor connects to the first end of the driving transistor, and the second end of the fourth transistor connects to one reference voltage end; and a fifth controllable transistor having a control end, a first end, and a second end, the control end of the fifth controllable transistor connects to a fourth scanning line, a first end of the fifth controllable transistor connects to a second voltage end, and the second end of the fifth controllable transistor connects to the first end of the driving transistor.

Wherein the driving transistor, the first controllable transistor through the fifth controllable transistor are NMOS TFTs, PMOS TFTs, or a combination of the NMOS TFTs and the PMOS TFTs, the control end, the first end, and the second end of the first controllable transistor through the fifth controllable transistor respectively correspond to a gate, a drain, and a source of the TFT.

Wherein the flat display device is an OLED or LCD.

In view of the above, the pixel compensation circuit and the method adopts the TFTs to be the driving transistor so as to avoid the threshold voltage drifting with respect to the driving transistor within the scanning driving circuit so as to avoid the non-uniform brightness of the panel.

DETAILED DESCRIPTION OF THE EMBODIMENTS

Embodiments of the invention will now be described more fully hereinafter with reference to the accompanying drawings, in which embodiments of the invention are shown.

Figure 1:
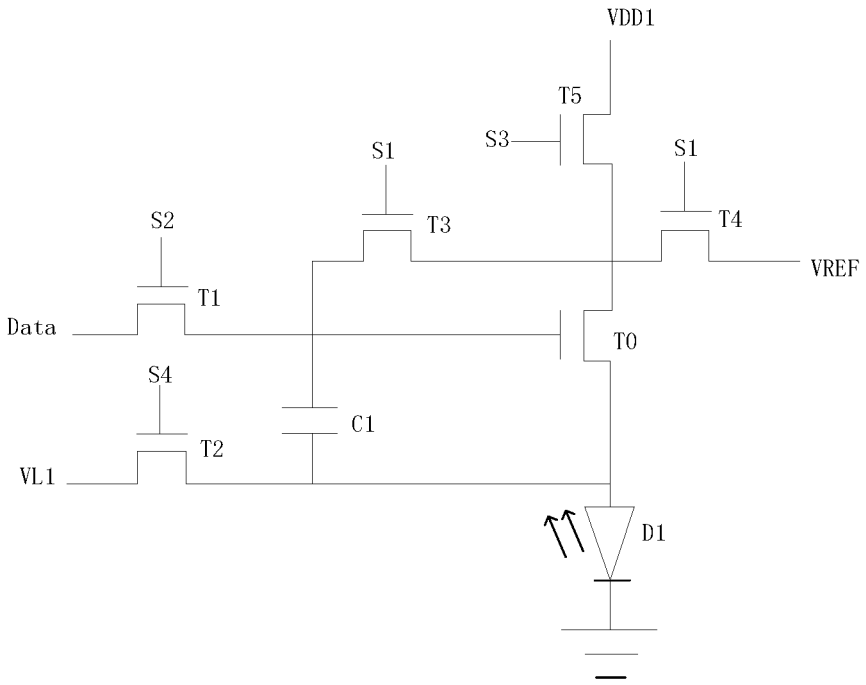
FIG. 1 is a schematic view of the pixel compensation circuit in accordance with one embodiment.

FIG. 1 is a schematic view of the pixel compensation circuit in accordance with one embodiment. As shown in FIG. 1, the pixel compensation circuit includes:

A first controllable transistor (T1) includes a control end, a first end, and a second end. The control end of the first controllable transistor (T1) connects to a first scanning line (S2), and the first end of the first controllable transistor (T1) connects to one data line (Data);

A driving transistor (T0) includes a control end, a first end, and a second end. The control end of the driving transistor (T0) connects to the second end of the first controllable transistor (T1).

A second controllable transistor (T2) includes a control end, a first end, and a second end. The control end of the second controllable transistor (T2) connects to a first voltage end (VL1), and the second end of the second controllable transistor (T2) connects to the second end of the driving transistor (T0);

An OLED (D1) having an anode and a cathode. The anode of the OLED (D1) connects to the second end of the driving transistor (T0), and the cathode of the OLED (D1) is grounded;

A storage capacitor (C1) includes a first end and a second end. The first end of the storage capacitor (C1) connects to the second end of the second controllable transistor (T2), and the second end of the storage capacitor (C1) connects to the control end of the driving transistor (T0);

A third controllable transistor (T3) includes a control end, a first end, and a second end. The control end of the third controllable transistor (T3) connects to a third scanning line (S1), the first end of the third controllable transistor (T3) connects to the control end of the driving transistor (T0) and the second end of the storage capacitor (C1), and the second end of the third controllable transistor (T3) connects to the first end of the driving transistor (T0).

A fourth controllable transistor (T4) includes a control end, a first end, and a second end. The control end of the fourth transistor (T4) connects to the third scanning line (S1), the first end of the fourth transistor (T4) connects to the first end of the driving transistor (T0), and the second end of the fourth transistor (T4) connects to one reference voltage end (VREF).

A fifth controllable transistor (T5) includes a control end, a first end, and a second end. The control end of the fifth controllable transistor (T5) connects to a fourth scanning line (S3), a first end of the fifth controllable transistor (T5) connects to a second voltage end (VDD1), and the second end of the fifth controllable transistor (T5) connects to the first end of the driving transistor (T0).

In the embodiment, the driving transistor (T0), the first controllable transistor through the fifth controllable transistor (T1~T5) are NMOS TFTs, PMOS TFTs, or a combination of NMOS TFTs and PMOS TFTs. The control end, the first end, and the second end of the first controllable transistor through the fifth controllable transistor (T1~T5) respectively correspond to a gate, a drain, and a source of the TFT.

Figure 2:
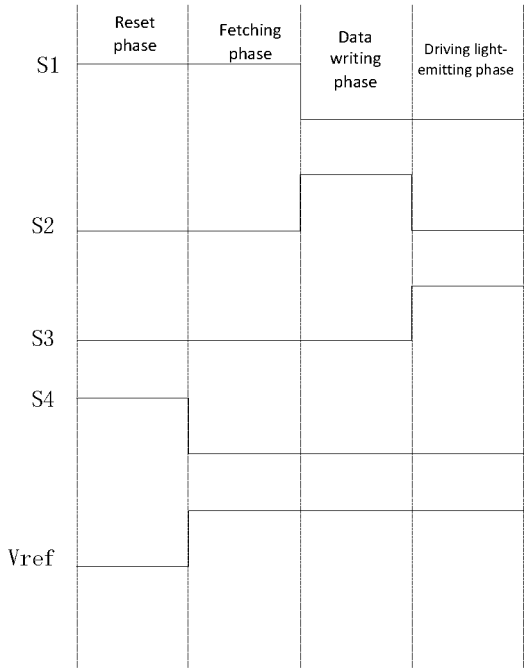
FIG. 2 is a waveform diagram of the pixel compensation circuit in accordance with one embodiment.
Figure 3:
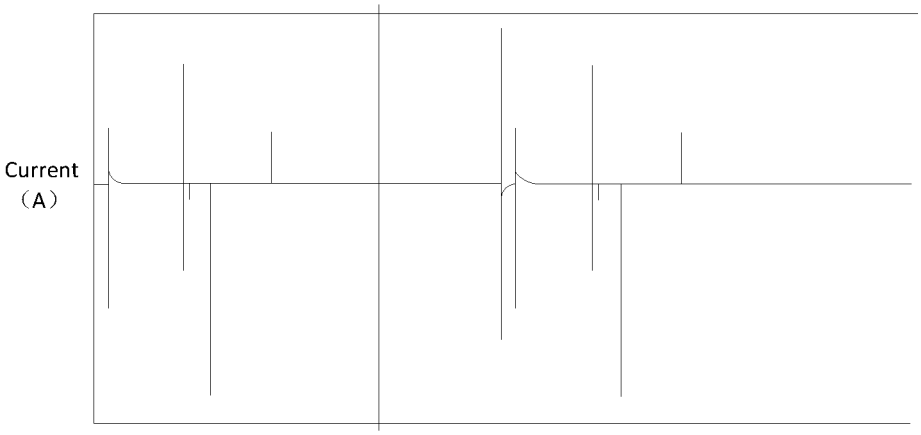
FIG. 3 is a simulation result of the pixel compensation circuit in accordance with one embodiment.

FIG. 2 is a waveform diagram of the pixel compensation circuit in accordance with one embodiment. FIG. 3 is a simulation result of the pixel compensation circuit in accordance with one embodiment. The operations principles of the pixel compensation circuit in FIGS. 1-3, i.e., the pixel compensation method, will be described hereinafter, During the reset phase, the driving transistor (T0), and the second controllable transistor (T2) through the fourth controllable transistor (T4) are turned on, and the first controllable transistor (T1) and the fifth controllable transistor (T5) are turned off. The voltage (Vg) at the control end of the driving transistor (T0) equals to the reference voltage (Vref) outputted by the reference voltage end (VREF), and the voltage (Vs) at the second end of the driving transistor (T0) equals to a first voltage (VL) outputted by the first voltage end (VL1);

During the threshold voltage fetching phase, the driving transistor (T0), the third controllable transistor (T3), and the fourth controllable transistor (T4) are turned on, and the first controllable transistor (T1), the second controllable transistor (T2), and the fifth controllable transistor (T5) are turned off. The voltage (Vg) at the control end of the driving transistor (T0) equals to the reference voltage (VREF), and the voltage (Vs) at the second end of the driving transistor (T0) equals to a difference between the reference voltage (VREF) and a threshold voltage (Vth) of the driving transistor (T0).

During the data writing phase, the driving transistor (T0) and the first controllable transistor (T1) are turned on, and the second controllable transistor (T2) through the fifth controllable transistor (T5) are turned off, and the storage capacitor (C1) is charged. The voltage (Vg) at the control end of the driving transistor (T0) equals to the data voltage (Vdata) outputted by the data line (Data), and the voltage (Vs) at the second end of the driving transistor (T0) satisfies the equation below:

$$Vs=V\text{ref}-Vth+\Delta V \qquad \text{Equation 1;}$$

Wherein the reference voltage (VREF) represents the reference voltage, threshold voltage (Vth) represents the threshold voltage of the driving transistor, ΔV represents the voltage increments caused by the voltage (Vg) at the control end of the driving transistor (T0). The coupling effect of the storage capacitor (C1) causes the voltage (Vs) at the second end of the driving transistor (T0) to change.

During the driving light-emitting phase, the driving transistor (T0) and the fifth controllable transistor (T5) are turned on. The first controllable transistor (T1) through the fourth controllable transistor (T4) are turned off, and voltage (Vgs) between the control end and the second end of the driving transistor (T0) satisfies the equation below:

$$Vgs=V\text{data}-V\text{ref}+Vth-\Delta V \qquad \text{Equation 2;}$$

The current (I) passing through the OLED (D1) satisfies the equation below:

$$I=K*(Vgs-Vth)^2=K*(V\text{data}-V\text{ref}-\Delta V)^2 \qquad \text{Equation 3;}$$

Wherein K is a coefficient satisfying the equation below:

$$K=\mu CoxW/(2*L) \qquad \text{Equation 4;}$$

Wherein μ represents the electron mobility, Cox represents the capacitance of the insulation layer of the TFT per unit of area, and L and W respectively represents a length and a width of the effective trench of the driving transistor (T0).

The above equations 3 and 4 and Table. 1 show the relationship between the current passing the OLED (D1) and the threshold voltage (Vth) of the driving transistor (T0).

TABLE 1

| Vdata | Vfb = 0.25 V $I_{OLED}$ | Vfb = −0.25 V $I_{OLED}$ | % $\Delta I_{OLED}$ | Vfb = 0.75 V $I_{OLED}$ | % $\Delta I_{OLED}$ |
|---|---|---|---|---|---|
| 8.5 V | 1.02388E−06 | 1.02357E−06 | −0.030276986 | 1.02233E−06 | −0.151384928 |
| 6 V | 7.5025E−07 | 7.6072E−07 | 1.395534822 | 7.4049E−07 | −1.3008997 |
| 4.5 V | 3.242E−07 | 3.3756E−07 | 4.120913017 | 3.0991E−07 | −4.40777298 |
| 3 V | 2.622E−08 | 2.857E−08 | 8.962623951 | 2.402E−08 | −8.390541571 |
| 2.2 V | 1.18E−09 | 1.2E−09 | 1.694915254 | 1.07E−09 | −9.322033898 |
| 1.8 V | 2.8E−10 | 2.9E−10 | 3.571428571 | 2.6E−10 | −7.142857143 |

Thus, the pixel compensation circuit avoiding the threshold voltage ($V_{th}$) drifting with respect to the driving transistor (T0) within the scanning driving circuit so as to avoid the non-uniform brightness of the panel.

Figure 4:
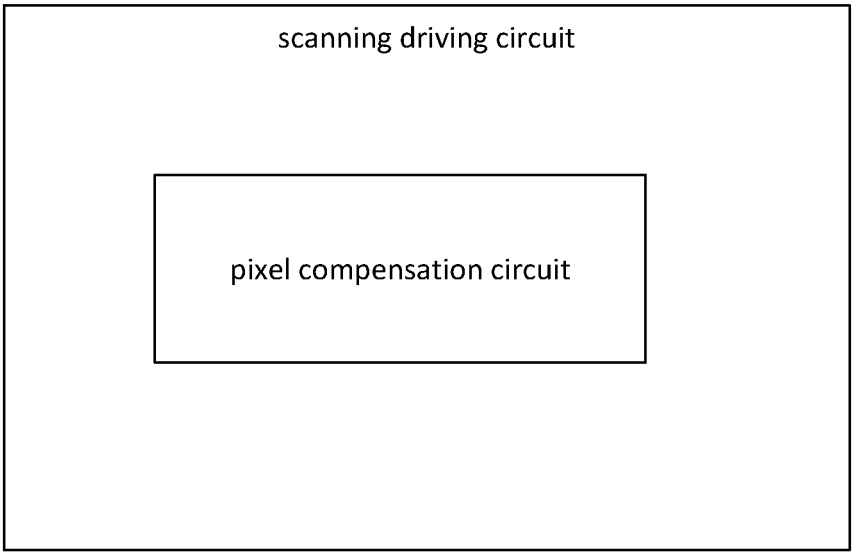
FIG. 4 is a schematic view of the scanning driving circuit in accordance with one embodiment.

FIG. 4 is a schematic view of the scanning driving circuit in accordance with one embodiment. The scanning driving circuit includes the pixel compensation circuit for avoiding the threshold voltage drifting with respect to the driving transistor (T0) within the scanning driving circuit so as to avoid the non-uniform brightness of the panel.

Figure 5:
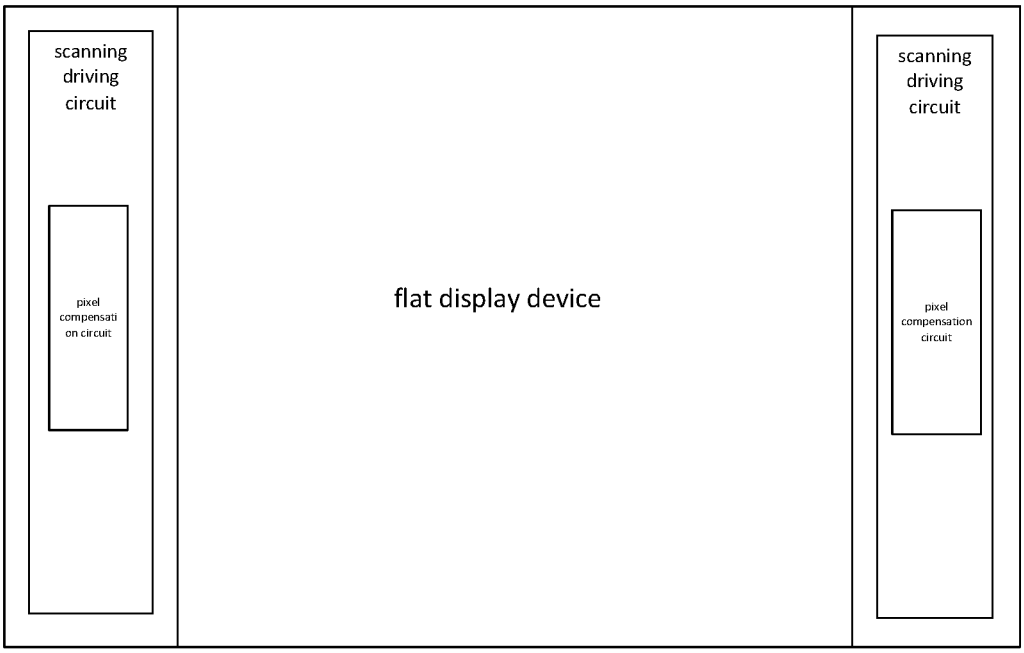
FIG. 5 is a schematic view of the flat display device in accordance with one embodiment.

FIG. 5 is a schematic view of the flat display device in accordance with one embodiment. The flat display device may be OLED or LCD including the above scanning driving circuit and the above pixel compensation circuit. The scanning driving circuit having the pixel compensation circuit is arranged in a rim of the flat display device. In an example, the scanning driving circuits are arranged at two ends of the flat display device.

The pixel compensation circuit and the method adopts the TFTs to be the driving transistor so as to avoid the threshold voltage drifting with respect to the driving transistor within the scanning driving circuit so as to avoid the non-uniform brightness of the panel.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A pixel compensation method, comprising:

during a reset phase, a driving transistor, and a second controllable transistor, a third controllable transistor, a fourth controllable transistor are turned on, and a first controllable transistor and a fifth controllable transistor are turned off, a voltage at the control end of the driving transistor equals to a reference voltage outputted by a reference voltage end, and the voltage at the second end of the driving transistor equals to a first voltage outputted by a first voltage end;

during a threshold voltage fetching phase, the driving transistor, the third controllable transistor, and the fourth controllable transistor are turned on, and the first controllable transistor, the second controllable transistor, and the fifth controllable transistor are turned off, the voltage at the control end of the driving transistor equals to the reference voltage, and the voltage at the second end of the driving transistor equals to a difference between the reference voltage and a threshold voltage of the driving transistor;

during a data writing phase, the driving transistor and the first controllable transistor are turned on, and the second controllable transistor, the third controllable transistor, the fourth controllable transistor, and the fifth controllable transistor are turned off, and a storage capacitor is charged, the voltage at the control end of the driving transistor equals to a data voltage outputted by a data line, and the voltage at the second end of the driving transistor satisfies the equation below:

$$Vs=V\text{ref}-Vth+\Delta V;$$

wherein Vref represents the reference voltage, Vth represents the threshold voltage of the driving transistor, ΔV represents the voltage increments of the second end of the driving transistor; and during a driving light-emitting phase, the driving transistor and the fifth controllable transistor are turned on, the first controllable transistor, the second controllable transistor, the third controllable transistor, and the fourth controllable transistor are turned off, and voltage between the control end and the second end of the driving transistor satisfies the equation below:

$$Vgs=V\text{data}-V\text{ref}+Vth-\Delta V;$$

a current passing through the OLED satisfies the equation below:

$$I=K^*(Vgs-Vth)^2=K^*(V\text{data}-V\text{ref}-\Delta V)^2;$$

wherein Vdata represents the data voltage outputted by the data line, and K is a coefficient.

2. The pixel compensation method as claimed in claim 1, wherein the driving transistor, the first controllable transistor, the second controllable transistor, the third controllable transistor, the fourth controllable transistor, and the fifth controllable transistor are NMOS TFTs, PMOS TFTs, or a combination of the NMOS TFTs and the PMOS TFTs, the control end, the first end, and the second end of the first controllable transistor, the second controllable transistor, the third controllable transistor, the fourth controllable transistor, and the fifth controllable transistor respectively correspond to a gate, a drain, and a source of the TFT.

* * * * *